US011682281B2

(12) United States Patent
Grennan

(10) Patent No.: US 11,682,281 B2
(45) Date of Patent: Jun. 20, 2023

(54) SECURITY SYSTEM AND APPARATUS

(71) Applicant: Robert Kevin Grennan, Schaumburg, IL (US)

(72) Inventor: Robert Kevin Grennan, Schaumburg, IL (US)

( * ) Notice: Subject to any disclaimer, the term of this patent is extended or adjusted under 35 U.S.C. 154(b) by 0 days.

(21) Appl. No.: 17/705,209

(22) Filed: Mar. 25, 2022

(65) Prior Publication Data

US 2022/0215731 A1 Jul. 7, 2022

Related U.S. Application Data

(62) Division of application No. 16/919,096, filed on Jul. 1, 2020, now Pat. No. 11,393,311.

(51) Int. Cl.

| | |
|---|---|
| ***G08B 15/00*** | (2006.01) |
| ***G08B 15/02*** | (2006.01) |
| ***G08B 13/08*** | (2006.01) |
| ***G08B 13/04*** | (2006.01) |

(52) U.S. Cl.
CPC ..... *G08B 15/02* (2013.01); *G08B 13/04* (2013.01); *G08B 13/08* (2013.01)

(58) Field of Classification Search
CPC ..... G08B 15/02; G08B 13/04; G08B 13/08
See application file for complete search history.

(56) References Cited

U.S. PATENT DOCUMENTS

2005/0252992 A1* 11/2005 Shimoda ..... F17C 13/04 239/498
2011/0050418 A1* 3/2011 Hart ..... G08B 15/02 340/541

* cited by examiner

*Primary Examiner* — Ojiako K Nwugo
(74) *Attorney, Agent, or Firm* — Justin Lampel

(57) ABSTRACT

A security system and apparatus for a home or business is provided. The security system has a sensor connected to a liquid dispenser. The sensor is triggered upon the breaking of glass or a door of a building. The liquid dispenser, when activated, dispenses a non-toxic liquid marker. The liquid dispenser sprays a mist of the liquid on the intruder so that the intruder may be easily identified.

10 Claims, 2 Drawing Sheets

SECURITY SYSTEM AND APPARATUS

CROSS REFERENCE TO RELATED APPLICATION

The present application is a divisional application of U.S. Ser. No. 16/919,096 which is currently co-pending.

BACKGROUND OF THE INVENTION

A security system and apparatus for a home or business is provided. The security system has a sensor connected to a liquid dispenser. The sensor is triggered upon the breaking of glass or a door of a building. The liquid dispenser, when activated, dispenses a non-toxic liquid marker. The liquid dispenser sprays a mist of the liquid on the intruder so that the intruder may be easily identified.

Security systems for homes and businesses are common. For example, U.S. Pat. No. 10,324,214 to Luis discloses an electrostatic field sensor and security system in interior spaces and exterior spaces which can measure electrostatic fields and the variations thereof along a metal conductor that acts as a detection probe or antenna. The antenna is connected to an electronic circuit which is able to decode the changes in the electrostatic field around the conductor and to detect minuscule variations in the electrostatic field by means of a processor enabling the clear detection of a human presence in an area surrounding the antenna and the ability to differentiate between a human presence and any other type of animal or object.

Further, U.S. Pat. No. 8,018,339 to Morita discloses an intruder detection system in which a detection range can be set to a predetermined one so that false detection caused by a moving object outside the predetermined range can be diminished. The system includes a transmission-side leaky transmission line that radiates a detection signal for detecting an intruder and a reception-side leaky transmission line that receives a detection signal leaked from the transmission-side leaky transmission line, both of which are buried spaced apart from each other in a detection surveillance area, and detects the presence/absence of an intruder in the detection surveillance area based on variations in the detection signal received by the reception-side leaky transmission line, wherein at least part of either the transmission-side leaky transmission line or the reception-side leaky transmission line is made of a surface-wave-type leaky coaxial transmission line, and the other leaky transmission line, a radiation-type leaky coaxial transmission line.

Still further, U.S. Pat. No. 4,879,544 to Maki discloses an intrusion detection system using waves guided by the conductive outer sheath of a coaxial cable. An r.f. signal from a transmitter is supplied between the inner conductor and outer conductor or shield in conventional fashion. Coupled wave devices are spaced along the cable; each coupled wave device transferring r.f. energy between a transmission mode within the cable and a guided mode propagated along the exterior of the conductive outer shield. In one embodiment a second coaxial cable similarly provided with coupled wave devices is spaced from the transmitter cable and has one end connected to a receiver. The change in r.f. coupling between the cables caused by an intruder produces variations in the r.f. energy coupled to the second cable which is detected at the receiver. Alternative embodiments include the use of a single cable with coupled wave devices adapted for both transmission and reception. Further alternative configurations include the use of a leaky coaxial cable, preferably buried, operating in combination with a cable provided with coupled wave devices. In some circumstances a single elongated conductor can support the guided mode. The guided mode can be established in the outer shield or single conductor by an external source and need not always be coupled from the cable interior.

However, these patents fail to describe a security system for a home or business which is easy to use. Further, these patents fail to provide for a security system for a business or home which leaves a visible marker on the intruder.

SUMMARY OF THE INVENTION

A security system and apparatus for a home or business is provided. The security system has a sensor connected to a liquid dispenser. The sensor is triggered upon the breaking of glass or a door of a building. The liquid dispenser, when activated, dispenses a non-toxic liquid marker. The liquid dispenser sprays a mist of the liquid on the intruder so that the intruder may be easily identified.

An advantage of the present security system for a home or business is that the present security system is easy to install.

Another advantage of the present security system for a home or business is that the present security system places a visible marker on the intruder which can be detected after the intruder leaves the home or business.

Yet another advantage of the present security system for a home or business is that the present security system allows police and other authorities to identify an intruder.

Another advantage is that the present security system and apparatus may have a floor unit which sprays and or marks shoes of an intruder when the floor unit is stepped on.

For a more complete understanding of the above listed features and advantages of the security system for a home or business reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

A security system and apparatus for a home or business is provided. The security system has a sensor connected to a liquid dispenser. The sensor is triggered upon the breaking of glass or a door of a building. The liquid dispenser, when activated, dispenses a non-toxic liquid marker. The liquid dispenser sprays a mist of the liquid on the intruder so that the intruder may be easily identified.

Figure 1:
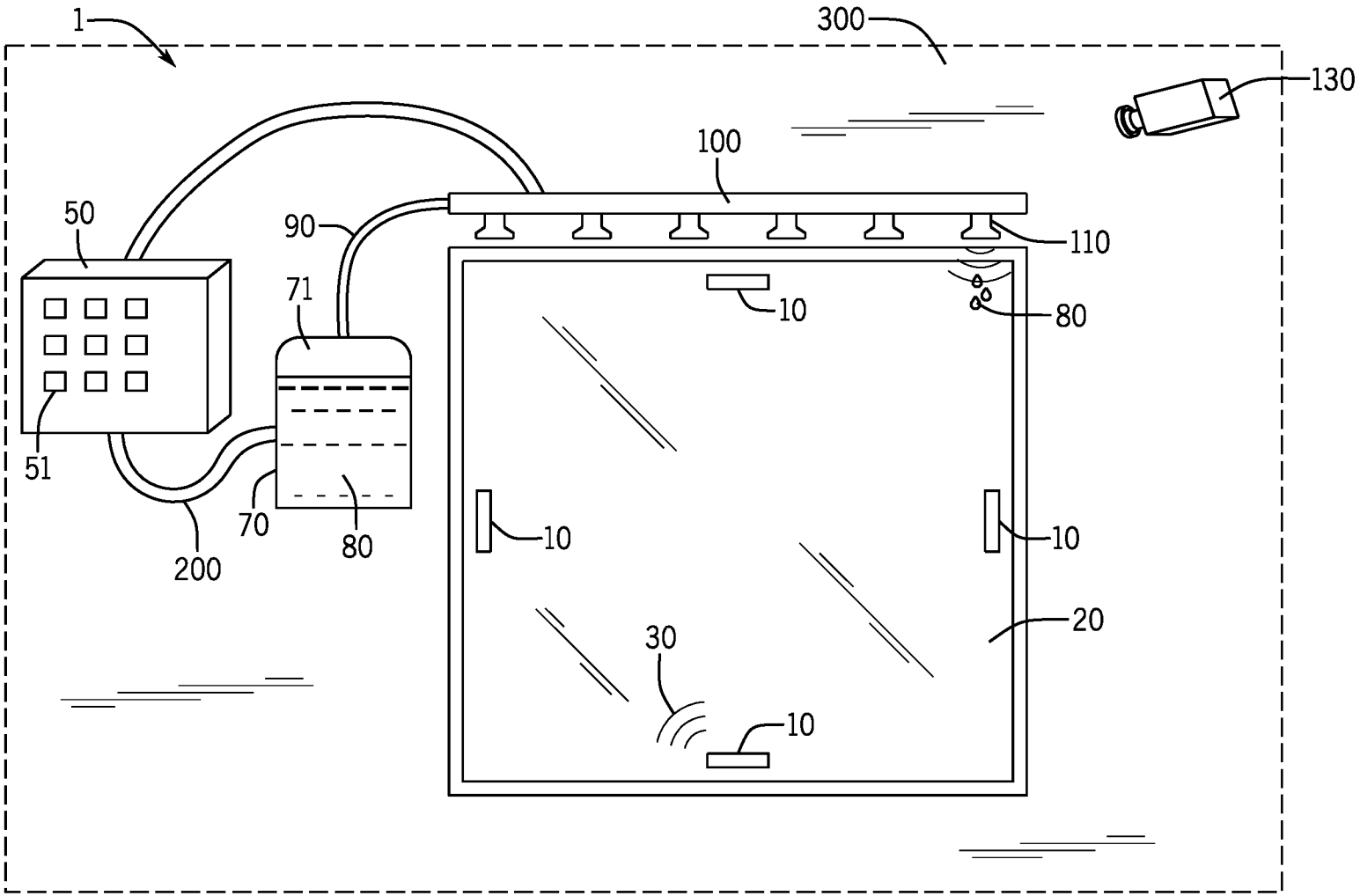
FIG. 1 illustrates the wall sprayer components of the security system and apparatus.

Referring first to FIG. 1, in an embodiment, a security system 1 is provided. The security system 1 may have a plurality of different components. Specifically, the security system 1 may have a plurality of sensors 10 which are strategically located around a window or door 20. FIG. 1 illustrates the sensors 10 attached to a window, however, the sensors 10 may be used in connection with a door. Further, the sensors 10 in FIG. 1 are located actually attached to the window 20, however, the sensors 10 may also be secured around the window/door 20 provided the sensors 10 can detect breakages.

The sensors 10 may send wireless signals 30 to a control panel 50 or the sensors 10 may be electrically connected to the control panel 50 via a wire (not shown). In an embodiment the control panel 50 is located within the home or business 300 in a secure location. The control panel 50 may have a plurality of buttons 51 which allows a user to program the security system 1.

In an embodiment, the security system 1 has a cannister/reservoir 70 having an interior 71 wherein a liquid 80 is stored within the interior 71 of the cannister/reservoir 70. The cannister/reservoir 70 is generally secured to a wall in the home or business 300. Preferably, the liquid 80 in the cannister/reservoir 70 is a non-toxic paint. In one embodiment, the paint may be fluorescent and only visible under a black or other specialty light. Still further, in an embodiment, the liquid may be a dye as is commonly used in bank dye packs, such as Disperse Red 9, which makes removal or the paint from objects, like skin, difficult for a few days. The liquid 80 is detectable either by the naked eye or by other means, such as fluorescent light. In addition, alternative substances may be dispensed from the cannister/reservoir 70 (other than dyes, paints, etc) provided that it can leave a visible marking.

In an embodiment, the cannister/reservoir 70 is connected via a tube/hose 90 to a dispensing pipe 100 (or manifold) located preferably next to the window/door 20. FIG. 1 illustrates the preferred embodiment of the dispensing pipe 100 located directly above a window 20 although it should be noted that the dispensing pipe 100 may be located below the window and spray upward, to the side of the window 20 or a combination thereof. The dispending pipe 100 may have at least one, preferably more, nozzles 110 which dispense the liquid 80 once the sensor 10 is triggered by the breaking, cracking or disturbing of the window 20. In an embodiment, the liquid 80 is dispensed under high pressure. In an embodiment, the security system 1 also has a camera 130 which catches video and/or audio of the interior of the home or business 300. The audio feature may both record sound and may also emit an alarm.

Figure 2:
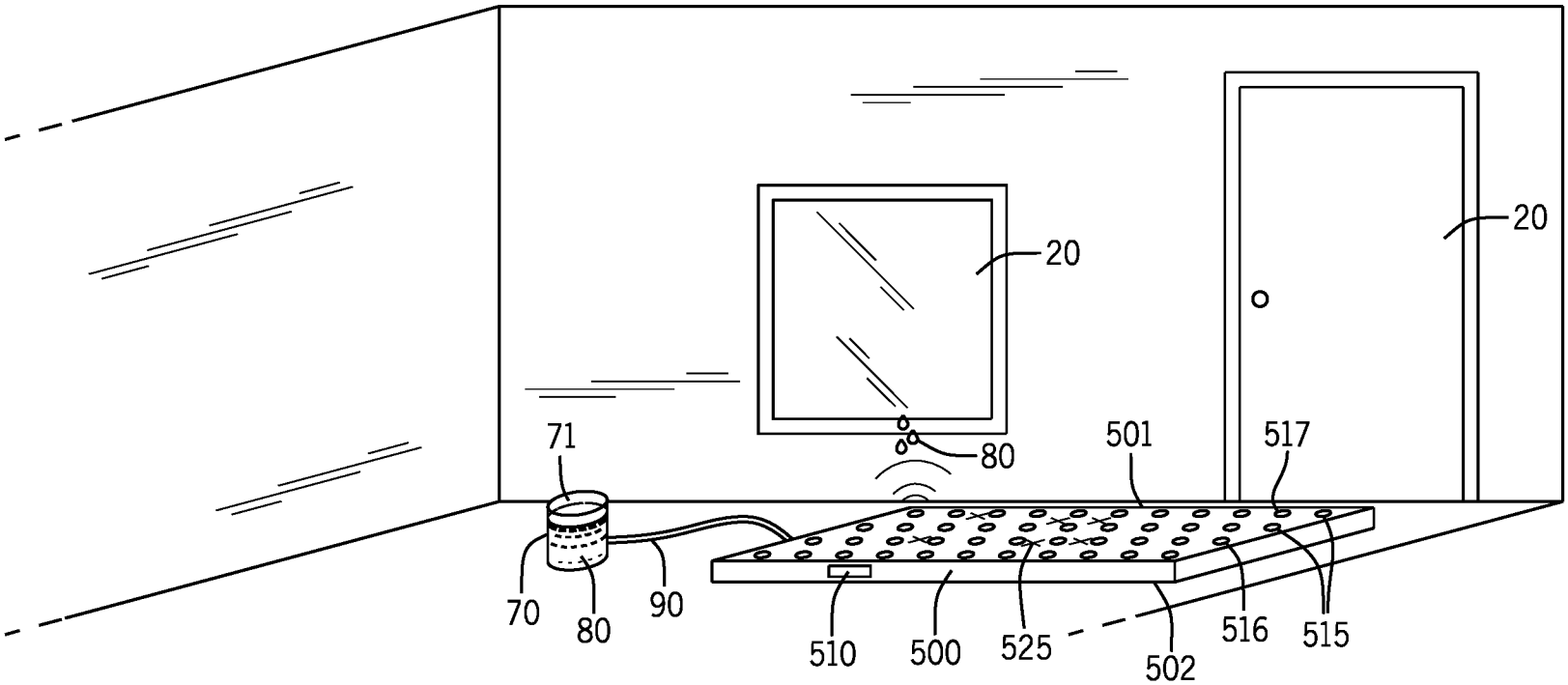
FIG. 2 illustrates the floor sprayer components of the security system and apparatus.

Referring now to FIG. 2, in one embodiment, the system may have a floor unit 500 (which may be a padded area). The floor unit 500 may be used separately or in addition to the wall unit shown in FIG. 1. The floor unit 500 may have a top 501 and a bottom 502. The top 501 of the floor unit may have a plurality of openings 515 which spray the liquid 80 located within the reservoir 70. A sensor 510 may sense when the floor unit 500 is stepped on and may activate the reservoir 70 to spray the intruder. In an embodiment, different openings 516, 517 may alternatively spray different colors. By way of example, openings 515 may spray a red dye, 516 may spray a blue dye and 517 may spray an orange dye. The unique location and color of the sprays may therefore specifically identify a unique pattern on the bottom of the user's shoes/pants which is unique to the store or home. Further, a unique marker 525 (identified as an 'X' in FIG. 2) may be unique to that specific control panel 50 of the store or home.

In one embodiment, the floor unit 500 is not connected to a reservoir 70 and instead, the liquid 80 is merely located within the interior of the floor unit 500. When pressure is applied to the floor unit 500 by, for example, stepping on the floor unit 500, the liquid 80 is dispensed onto the person's shoes and or pants by the force of being stepped on.

In one embodiment, the floor unit 500 and/or the wall unit of FIG. 1 may dispense a foam and or a non-liquid component such as, for example, glitter in addition to, or alternative to, the liquid 80. The foam and or glitter may also, in an embodiment, be uniquely formulated to identify the specific control panel 50 (and therefore store or home which was broken into).

When an intruder breaks a window 20 of a home or business 300 or breaks through a door of the home or business 300, the sensors 10 are triggered and relay a signal to the control panel 50. The control panel 50 then sends a signal, either wirelessly or through a wire 200 as shown in FIG. 1, to the cannister/reservoir 70. The cannister/reservoir 70 then pumps the liquid 80 through the tube 90 to the dispensing pipe 100 which sends the liquid 80 through the nozzles 110 and on to the intruder's body and clothes. Preferably, the liquid 80 is dispensed in a fine mist; however, the owner may set the control panel 50 to dispense the liquid 50 at different concentration levels. Hopefully, once sprayed, the intruder flees the home or business 300 immediately.

In one embodiment, the system 1 may only be triggered if a specific predetermined percentage of the sensors 10 are triggered. For example, a user may set the control panel 50 to require, for example, three of four sensors 10 to be activated before the system 1 will dispense the liquid 80. Further, in an embodiment, the system 1 may be programmed to only dispense the liquid 80 right at the point of entry, so that other products in the store or home are not destroyed.

Because the intruder is covered in the visible liquid 80, which is preferably a non-toxic paint which is difficult to remove and unique to the specific control panel/store/home, local authorities are able to identify the proper intruder who may be fleeing nearby.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. A security system is provided comprising:

a dispensing pipe wherein the dispensing pipe has at least one opening;

a plurality of sensors wherein the plurality of sensors are attached to a window or a door;

a liquid located within the dispensing pipe wherein the liquid is dispensed from the dispensing pipe upon a predetermined percentage of the sensors being activated by a break in the window or door.

2. The security system of claim 1 wherein the liquid is a paint or dye.

3. The security system of claim 2 wherein the paint or dye is fluorescent.

4. The security system of claim 1 wherein the dispensing pipe is located directly above, below or on the side of the window or door.

5. The security system of claim 1 further comprising:

a reservoir having an interior wherein the liquid is located in the reservoir prior to being dispensed from the dispensing pipe; and a tube connecting the reservoir to the dispensing pipe.

6. The security system of claim 1 further comprising:

a control panel electrically connected to the dispensing pipe for programing the dispensing pipe.

7. The security system of claim 2 wherein the dispensed liquid is uniquely formulated to identify a specific control panel.

8. The security system of claim 1 wherein a non-liquid component is added to the liquid.

9. The security system of claim 8 wherein the non-liquid component is glitter.

10. A security system is provided comprising:

a dispensing pipe wherein the dispensing pipe has at least one opening;

a sensor wherein the sensor is attached to a window or a door;

a liquid located within the dispensing pipe wherein the liquid is dispensed from the dispensing pipe upon the sensor being activated by a break in the window or door;

wherein the liquid is a paint or dye; and wherein the dispensed liquid is uniquely formulated to identify a specific control panel.

* * * * *